US008100652B2

(12) United States Patent
Bauer et al.

(10) Patent No.: US 8,100,652 B2
(45) Date of Patent: Jan. 24, 2012

(54) CEILING FAN COMPLETE COVER

(76) Inventors: Steven M. Bauer, Simi Valley, CA (US); Antonia M. Bauer, Simi Valley, CA (US)

( * ) Notice: Subject to any disclaimer, the term of this patent is extended or adjusted under 35 U.S.C. 154(b) by 821 days.

(21) Appl. No.: 12/172,924

(22) Filed: Jul. 14, 2008

(65) Prior Publication Data

US 2010/0008777 A1 Jan. 14, 2010

(51) Int. Cl.
*F04D 29/00* (2006.01)

(52) U.S. Cl. ..... 416/62; 416/247 R; 53/417; 53/461; 150/154; 150/158; 150/165

(58) Field of Classification Search ..... 416/62, 416/247 R; 150/154, 158, 165; 53/417, 53/461
See application file for complete search history.

(56) References Cited

U.S. PATENT DOCUMENTS

| | | | | | |
|---|---|---|---|---|---|
| 2,417,636 | A | * | 3/1947 | Ditzler et al. | 126/110 R |
| 2,812,900 | A | * | 11/1957 | Matthews | 416/247 R |
| 2,923,463 | A | * | 2/1960 | Shunkwiler | 416/247 R |
| 3,321,240 | A | | 5/1967 | Lilienstern | |
| 4,832,572 | A | | 5/1989 | Prucha et al. | |
| 5,281,093 | A | | 1/1994 | Sedlak et al. | |
| 5,516,264 | A | | 5/1996 | Anetrini | |
| 5,564,900 | A | | 10/1996 | McAuley | |
| 5,582,115 | A | | 12/1996 | Muller | |
| 5,591,005 | A | | 1/1997 | McCready | |
| 5,591,006 | A | | 1/1997 | DeMeo et al. | |
| 5,664,975 | A | * | 9/1997 | Carlisle | 440/49 |
| 5,868,189 | A | * | 2/1999 | Jarvis | 150/165 |
| 5,947,686 | A | | 9/1999 | Keys | |
| 6,015,261 | A | | 1/2000 | Barone | |
| 6,019,479 | A | | 2/2000 | Barker | |
| D423,094 | S | * | 4/2000 | Rodnell | D23/412 |
| D453,219 | S | | 1/2002 | Godfrey | |
| 6,619,920 | B1 | | 9/2003 | Cannon | |
| 6,916,217 | B1 | * | 7/2005 | Crepeau | 440/71 |
| 7,056,090 | B1 | | 6/2006 | Strengel | |
| RE39,945 | E | * | 12/2007 | Brown | 150/161 |
| 2003/0017763 | A1 | * | 1/2003 | Miller | 440/71 |
| 2005/0147494 | A1 | * | 7/2005 | Hoshino | 416/62 |
| 2007/0212222 | A1 | | 9/2007 | White-Burnett | |

* cited by examiner

*Primary Examiner* — Angel Roman
(74) *Attorney, Agent, or Firm* — Marc E. Hankin; Kevin Schraven; Hankin Patent Law, APC

(57) ABSTRACT

Disclosed is a ceiling fan cover for protecting a ceiling fan while the ceiling fan is not in use. The invention comprises a cover, preferably of a semi-waterproof, vinyl material, that encloses an indoor or outdoor ceiling fan. The invention also includes an attachment means, preferably a zipper, to close the cover around the ceiling fan's blades and a drawstring to tighten up the cover around the top of the fan. The invention could have an additional drawstring to cinch the middle. An alternative embodiment would be made of a plastic, disposable material, for use by painters to protect ceiling fans. When the cover is in place, it prevents ceiling fan blades from spinning in the wind or swinging up and breaking off, and also protects the fan from dust and debris.

7 Claims, 2 Drawing Sheets

CEILING FAN COMPLETE COVER

FIELD OF INVENTION

This invention relates generally to a cover for use with a ceiling fan. More specifically, this invention relates to removable devices for covering a ceiling fan, to protect the fan from elements such as dust, dirt, and wind.

BACKGROUND

Ceiling fans are popular for circulating air in rooms. With the increasing emphasis on maximizing living space, ceiling fans are now available for installation outdoors, such as for use above an outdoor patio. The outdoor use of ceiling fans leads to problems apparent in indoor ceiling fans, along with their own problems. Ceiling fans, in general, accumulate dust, dirt, grease and other unsavory elements by virtue of having blades open to the environment. Outdoor ceiling fans are prone to more debris, and consequently, faster deterioration. Furthermore, outdoor ceiling fans' blades tend to spin freely in the wind, which may cause them to collide with another object or swing up and break off. Indoor ceiling fans are at risk when construction projects, such as painting or drywalling, are performed. Ceiling fan blades are now being produced in unique shapes and sizes, such as palm fronds. Prior covers are limited in their ability to fit over blades of all sizes, particularly blades of an irregular shape. The present invention seeks to solve these problems, and in doing so, increase the life of the fan and blades. The cover is easy to install and remove, can be used with all light kits and can be quickly washed off with a hose.

In the past, ceiling fan covers have only covered the individual blades of a fan, as opposed to covering an entire ceiling fan. The problem with such covers is that they do not protect the housing for the light and motor, nor do they solve the problem of the blades spinning freely in the wind and causing damage to nearby walls, ceilings, and breaking off. Prior patents have only solved the problem of dust accumulating on the blades themselves.

U.S. Pat. No. 4,832,572, issued to Prucha et al., discloses a protective cover for fan blades of ceiling fans, where one cover fits many sizes and contours of fan blades. The cover has an elastized open portion that slips over the fan and is secured by a closure band. The sleeve, while on the fan, conforms to the shape and size of the blade. While this is helpful, it does not protect the fan housing from dust, or debris from construction. Also, it would not be useful to stop outdoor ceiling fans from spinning freely to cause damage.

Many other patents disclose a ceiling fan cover that protects the blades from dust and dirt. U.S. Pat. No. D453,219, issued to Godfrey, discloses an ornamental design for a decorative ceiling fan blade cover. It is an ornamental piece designed to be aesthetically pleasing. U.S. Pat. No. 5,281,093, issued to Sedlak, et al., discloses a fan blade cover with a zipper. Sedlak, however, does not protect the fan's housing and motor, nor does it prevent blades from spinning. U.S. Pat. No. 5,516,264, issued to Anetrini, discloses a blade slip cover composed of a fitted case and an elastic gather for securing the cover to the blade. Anetrini only covers the blade and is for decorative purposes. U.S. Pat. No. 5,564,900, issued to McAuley, discloses a removable fan blade cover slip, designed mainly to protect the lower face of a ceiling fan blade. McAuley functions as a decorative fan blade, and even provides air freshener, but it does not protect the fan housing or top of the fan blade. U.S. Pat. No. 5,591,005, issued to McCready, is a fan blade cover for a fan blade of a ceiling fan, similar in design to McAuley. It is primarily a decorative cover. U.S. Pat. No. 5,947,686, issued to Keyes, is a fan blade cover which is easily removed and cleaned. It also includes an air freshener. Keyes functions to protect the fan blades, provide a decorative cover, and freshen a room. It is not capable of protecting the fan's housing or keeping blades stationary. U.S. Pat. No. 6,015,261, issued to Barone, discloses a removable and replaceable cover for a ceiling fan blade. It only protects the bottom face of the blade. U.S. Pat. No. 6,619,920, issued to Cannon, is an adjustable ceiling fan blade cover with an overlapping joint. It does not protect the fan housing nor prevent the fan blades from spinning. U.S. Pat. No. 6,019,479, issued to Barker, discloses a rigid fan cover for use with a strobe light. U.S. Pat. No. 5,591,006, issued to DeMeo, et al., is a removable, washable, decorative cover made of Spandex. U.S. Pat. No. 7,056,090, issued to Stengel, shows a ceiling fan cover with adhesive strips that does not protect the top of the fan blade. These patents, however, all fail to disclose a device which encloses the entire ceiling fan structure. The patents mainly function to protect the blades from dust, or provide decorative details, as opposed to protecting the blades from spinning or breaking off due to wind.

Patents also exist for outdoor furniture covers. U.S. Pat. No. 5,582,115, issued to Muller, titled "Outdoor Furniture Covers and Covering Methods," discloses covers for porch and patio furniture, particularly umbrella tables, chairs and chaise lounges. It is not adaptable to a ceiling fan cover. U.S. Pat. No. 3,321,240, issued to Lilienstern, et al., relates to protective coverings, and more particularly to protective coverings for use with outdoor furniture to protect such furniture or upholstery against the elements. These patents, however, fail to disclose a cover for a ceiling fan, or a zipper and drawstring as a preferred means of securing the covers. A number of patents exist for indoor furniture covers, but these patents were not directed to, nor adaptable to, ceiling fans.

Each of the previous conceptual designs provide only limited protection of ceiling fans and fail entirely to address the need to cover the fan housing and to prevent the fans from spinning in the wind. With the previous art, only the blades are protected from dust, and not from spinning.

The invention can be used by homeowners looking to increase the life of their fans, or contractors working around a ceiling fan. The ease of installing and removing the fan allow for quick and easy handling. It would take only a few minutes to put the cover around the fan, zip it up, and tighten the drawstring. When not in use, the cover can be compactly stored away.

SUMMARY OF THE INVENTION

The present invention is unique in that: the fan cover encloses the entire ceiling fan fixture, to protect the fan housing and blades and to prevent the blades from spinning in the wind. Also, it is capable of fitting many sizes of ceiling fans and ceiling fan blades.

The cover comprises a top panel stitched, or otherwise attached, to a bottom half, which is preferably manufactured of a semi-waterproof material, such as vinyl. The top panel includes an attachment means, such as a zipper, perpendicular to the bottom half, and drawstring at the top of the panel, parallel to the bottom half. In an alternative embodiment, the invention has another drawstring in the middle of the cover, parallel to the bottom half, to allow for a tighter fit.

The invention, with attachment means open and drawstring slackened, is placed around the ceiling fan by the user. When the invention is completely around the ceiling fan, the user closes the top panel. To fully close the ceiling fan cover, the user tightens and ties the drawstring. In an alternative embodiment, the user would also tighten the second drawstring for a tighter fit.

To remove the invention, the user would untie the drawstring, undo the attachment means and remove the cover from the ceiling fan. The user would do so when they want to use the ceiling fan. The cover is intended to be used while the fan is stationary.

In an alternative embodiment, the cover would be made of a disposable, plastic material, to be used by painters or general contractors while performing construction projects.

The present invention seeks to remedy problems seen in earlier ceiling fan covers, and to provide addition protection against the elements. By easily covering the entire ceiling fan, it is able to do so.

DRAWINGS—REFERENCE NUMERALS

Figure 1:
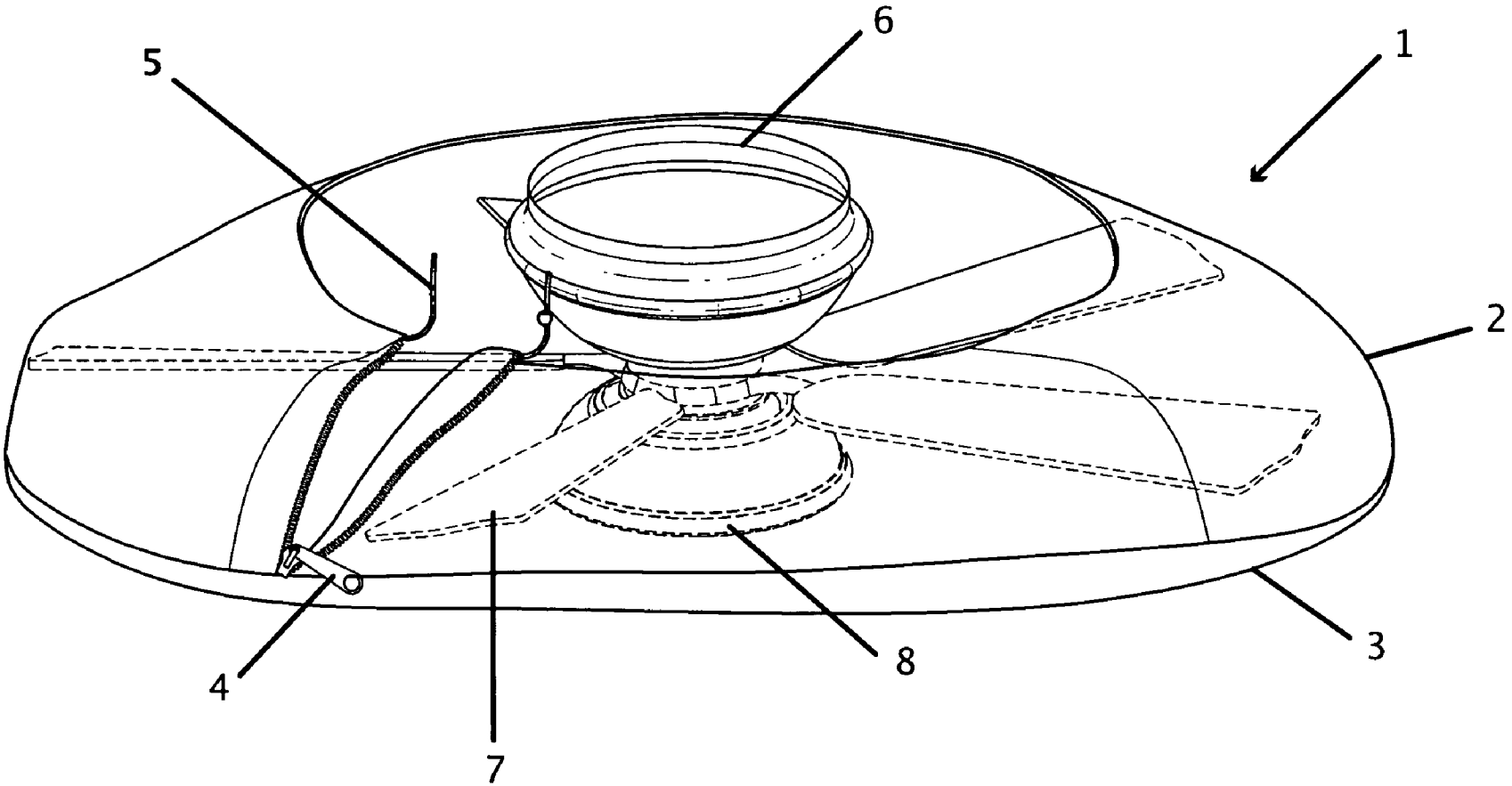
FIG. 1 is a perspective view of the present invention, open around a ceiling fan.

1 Fan cover
2 Top panel
3 Bottom half
4 Attachment means
5 Drawstring
6 Motor housing
7 Fan blades
8 Switch housing

DETAILED DESCRIPTION OF THE DRAWINGS

In FIG. 1 the present invention 1 is shown; an example of an open fan cover for protecting an entire ceiling fan, according to this invention, is shown. FIG. 1 indicates in a perspective view all of the parts of the invention, ready to be fitted onto a ceiling fan apparatus.

Figure 2:
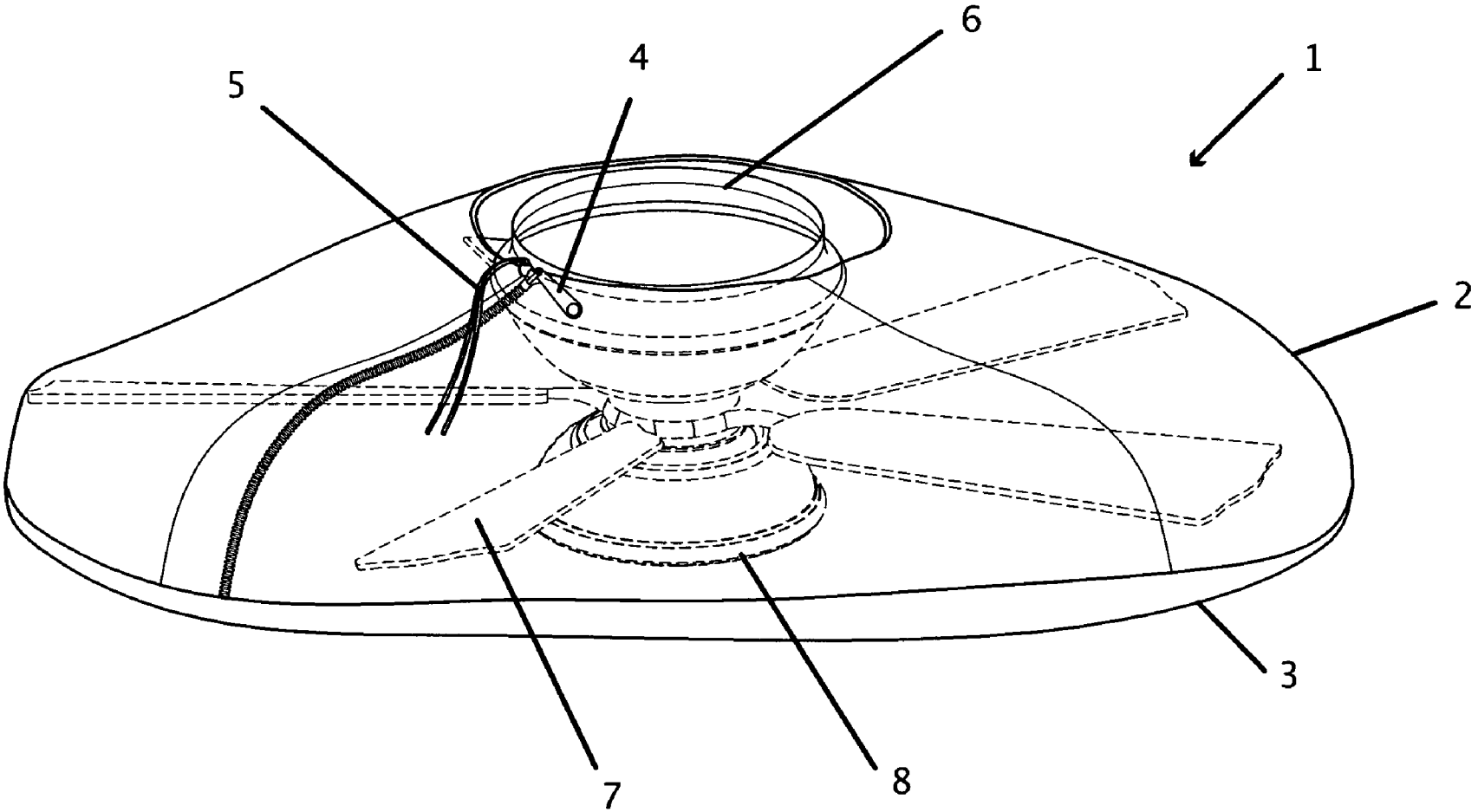
FIG. 2 is a perspective view of the present invention, closed around a ceiling fan.

In FIG. 2, the present invention 1 is shown; an example of a closed fan cover for protecting an entire ceiling fan, according to this invention, is shown. FIG. 2 indicates in a perspective view all of the parts of the invention, fitted onto a ceiling fan apparatus.

Referring to FIG. 1, it can be seen by the three-dimensional drawing that the present invention 1 includes a top panel stitched, or otherwise secured, to a bottom half, an attachment means such as a zipper, and a drawstring. Although zippers are a preferred side attachment means for at least one side, other side attachment means (such as a plurality of snaps, buttons, straps that interact with buckles, tie straps, or strips of Velcro) could be provided instead of zippers if desired, on either or both sides. The top panel 2 and bottom half 3 are preferably made of resilient, semi-waterproof, flexible vinyl material, while the drawstring 5 is preferably made of nylon or another resilient string.

The attachment means 4 is opened to allow the cover to fit around and over the motor housing 6, fan blades 7 and switch housing 8.

Referring to FIG. 2, it can be seen by the three-dimensional drawing that the present invention 1 is closed around a ceiling fan fixture.

The attachment means 4 is brought together to close the invention 1. It is attached or sewn into the top panel 2. At the top of the panel 2 is a drawstring 5. The drawstring 5 is used to tighten the invention 1 to close around the top of the motor housing 6. The top panel 2 is stitched, or otherwise secured, to the bottom panel 3. When closed, the invention 1 covers the motor housing 6, fan blades 7 and switch housing 8.

In one form of the present invention 1, the top panel 2 and bottom half 3 are made of disposable plastic to be used by painters and general contractors when working around ceiling fans.

In one form of the present invention 1, a second drawstring 5 is located at the mid-point of the top panel 2. The second drawstring 5 is used to pinch the middle and further tighten the invention.

The top panel 2 has a maximum circumference of 12 inches. The bottom half 3 has a maximum circumference of 55 inches. If the invention was bigger than these dimensions, it would not cinch down small enough to securely fit a ceiling fan.

Although the present invention has been described with reference to preferred embodiments, workers who are skilled in the art will recognize that changes may be made in form and detail without departing from the spirit and scope of the present invention.

What is claimed is:

1. A fan cover device comprising:

a fan cover;

wherein said fan cover is comprised of: a protective material including a bottom piece and a top piece;

wherein said bottom piece is substantially circular and has an outer circumference;

wherein said top piece is substantially ring-shaped and has an outer circumference and an inner circumference;

wherein said outer circumference of said bottom piece is attached to said outer circumference of said top piece, such that an interior pocket is formed between said top piece and said bottom piece;

wherein said top piece is comprised of an attachment means and a drawstring;

wherein said attachment means is openable and closable;

wherein said fan cover is adapted to be removably placed on a fan when said attachment means is open, such that a plurality of fan blades of said fan are substantially within said interior pocket;

wherein closing said attachment means when said fan cover is placed on a fan, substantially encloses said plurality of fan blades within said interior pocket and prevents said fan cover from being removed from said fan;

wherein said drawstring is adapted to tighten said fan cover around said plurality of fan blades of said fan when said fan cover is placed on said fan and said attachment means is closed.

2. The fan cover device of claim 1, wherein said protective material is semi-waterproof with vinyl.

3. The fan cover device of claim 1, wherein said protective material is disposable plastic.

4. The device of claim 1, wherein said fan cover is usable indoors or outdoors.

5. The fan cover device of claim 1, wherein said fan cover directly contacts said plurality of fan blades when said fan cover is placed on said fan.

6. The fan cover device of claim 1, wherein said drawstring is located at said inner circumference of said top piece.

7. The fan cover device of claim 1, wherein said fan is a ceiling fan.

* * * * *